US007182177B1

(12) United States Patent
Simnacher

(10) Patent No.: US 7,182,177 B1
(45) Date of Patent: Feb. 27, 2007

(54) LIFTING MECHANISM FOR A STORAGE DEVICE ON THE BED OF A PICKUP TRUCK

(76) Inventor: Larry W. Simnacher, P.O. Box 2217, Bay City, TX (US) 77401-2217

( * ) Notice: Subject to any disclaimer, the term of this patent is extended or adjusted under 35 U.S.C. 154(b) by 219 days.

(21) Appl. No.: 10/717,534

(22) Filed: Nov. 20, 2003

(51) Int. Cl.
*B66F 7/06* (2006.01)

(52) U.S. Cl. ..... 187/211; 296/37.6; 296/37.5; 224/404; 224/549; 211/105; 254/122

(58) Field of Classification Search ..... 187/269, 187/251, 258, 271; 242/187; 254/13, 89 R, 254/264, 418, 122; 74/39, 521; 182/69.3, 182/69.5; 211/105
See application file for complete search history.

(56) References Cited

U.S. PATENT DOCUMENTS 3,785,462 A 1/1974 Coad et al.
3,843,115 A 10/1974 Di Fulvio et al.
4,391,345 A 7/1983 Paul
4,405,116 A * 9/1983 Eisenberg ..... 254/122
4,534,544 A 8/1985 Heide
5,303,969 A * 4/1994 Simnacher ..... 296/37.6
5,366,203 A 11/1994 Huffman
5,395,209 A 3/1995 Busse et al.
6,364,060 B1 4/2002 Cherry
2002/0139618 A1* 10/2002 Anibas ..... 187/211

* cited by examiner

*Primary Examiner*—Kathy Matecki
*Assistant Examiner*—Stefan Kruer
(74) *Attorney, Agent, or Firm*—Egbert Law Offices

(57) ABSTRACT

A storage device for the bed of a pickup truck has a body with a storage area therein and a scissors lift connected to the body for moving the body between a first position on the bed of the truck and a second position above a side wall of the truck. The scissors lift includes a top plate, a bottom plate, first and second scissors pivotally connected to the top plates and a motor cooperative with the scissors so as to move the top plate relative to the bottom plate. A spring is in tension and extends between the scissors between when the body is in the first position.

7 Claims, 3 Drawing Sheets

FIG. 1
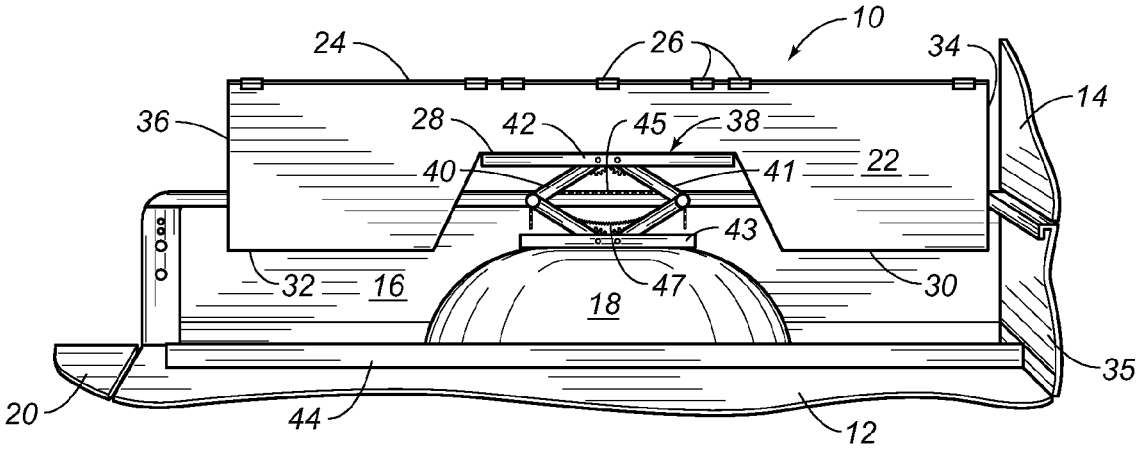
FIG. 2
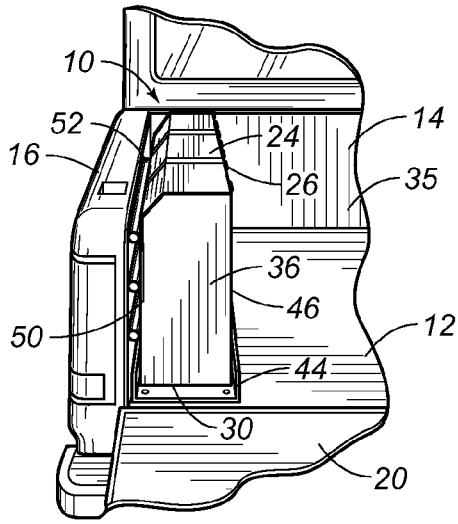
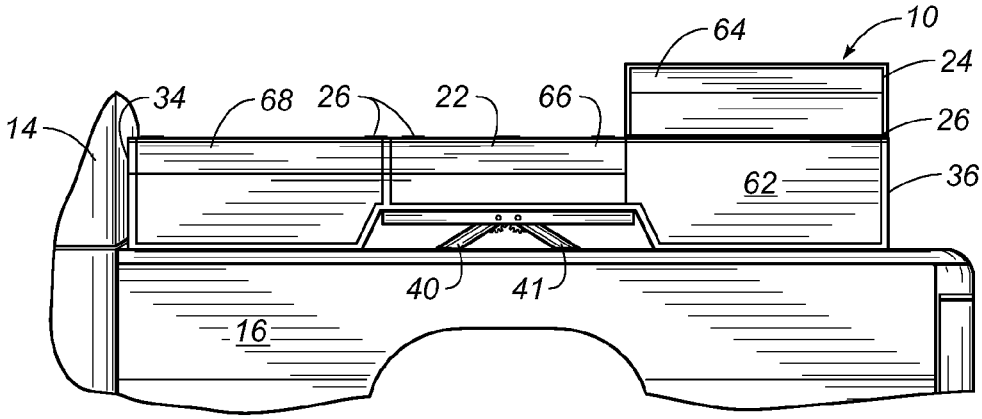
FIG. 3

LIFTING MECHANISM FOR A STORAGE DEVICE ON THE BED OF A PICKUP TRUCK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to storage devices, in general. More particularly, the present invention relates to storage devices that can be utilized in the bed of a pickup truck. Additionally, the present invention relates to storage devices that can be mechanically maneuvered by a scissor lift mechanism from a stowed position to a deployed position.

BACKGROUND OF THE INVENTION

Pickup trucks and vehicles having open cargo compartments are used extensively for transporting purposes. Apparatus have been developed to organize the cargo space and to minimize the motion of transported articles located therein during periods of transit. Such transported articles often need to be protected from inclement weather so covering the cargo compartment becomes important. When many different articles are being transported at the same time, segregating the articles is also an important consideration.

During certain types of transport, it is desirable to include a storage container in the rear of a pickup truck. The storage compartment serves to retain tools, and other items, so as to allow the user of the pickup truck to have access to such tools at the desired destination. Unfortunately, conventional tool boxes, in the back of pickup trucks, are often positioned in an extremely poor location. For example, some tool boxes are located in the bed of the of the pickup truck such that the operator is required to bend over the side wall of the vehicle in order to reach into the tool box and lift the tools from the tool box. Back strain can often occur from efforts to lift tools from the bed of the pickup truck. It is often difficult to look over the side wall of the pickup truck so as to inspect the variety of tools which reside in the tool box. Many tool boxes have been provided which successfully contain tools, but also reduce the amount of space in the cargo area of the pickup truck. Normally, the tool boxes of such pickup trucks must be locked so as to prevent theft. As a result, when the vehicle reaches the destination, a great deal of effort is taken so as to unlock the various tool boxes on the back of the pickup truck.

It has often been found that the wheel well of the pickup truck minimizes the amount of space that can be available for the receipt of tool boxes. Tool boxes have not been designed so as to accommodate the intruding presence of the wheel well.

Various patents have issued in the past which have described various types of tool boxes, organizers, and compartments for use on the back of pickup trucks.

U.S. Pat. No. 4,936,624, issued on Jun. 26, 1990, describes a tool box assembly for installation in pickup trucks. A pair of tool boxes are pivotally mounted in an enclosed frame for movement between an access position and a secured position. The movement of the tool boxes is driven by a hydraulic system. In the access position, the tool boxes are supported in an open position above the side wall of the truck. In the secured position, the tool boxes are enclosed completely by the frame which does not extend above the side walls of the truck. As the boxes are raised, the lids are automatically opened. When the boxes are lowered, the lids are closed and locked in a closed position.

U.S. Pat. No. 4,088,365, issued on May 9, 1978 to D. J. Johnson, describes a portable storage apparatus which is provided in conjunction with foldable camping trailers. This apparatus is suitable for mounting at an eye level or at an overhead position between a countertop and the ceiling of a trailer. The extended frame is provided to as to raise and lower the storage apparatus in a mechanical fashion.

U.S. Pat. No. 4,789,195, issued on Dec. 6, 1988 to N. R. Fletcher, U.S. Pat. No. 4,830,242, issued on May 16, 1989 to C. N. Painter, and U.S. Pat. No. 4,844,305, issued on Jul. 4, 1989 to J. W. McKneely, teach movable tool boxes for trucks. Each of these tool boxes are placed in a stationary position in the interior of the bed of the pickup truck. These tool boxes are arranged so as to be contained in a position that allows access above the side of the truck. In general, these devices are simply boxes which are configured to fit on the interior of the pickup truck.

French Patent No. 2,623,759, issued to M. Arriaza, teaches a hydraulically powered display unit that is presented in a vertical position at the side of the vehicle. A hydraulic piston-and-cylinder arrangement is provided on the floor of the vehicle and is fastened to a side of the display. Upon activation, the display will raise from the floor of the vehicle into an upright position along a side of the vehicle.

The present inventor is the owner of U.S. Pat. No. 5,303,969, issued on Apr. 19, 1994. This patent describes a storage device for a bed of a pickup truck having a body with a storage area therein. This storage device has a body with a storage area therein and a door affixed thereto. The door allows access to the storage area. A fluid-activated lifting mechanism is attached to the body at opposite ends of the body. The lifting mechanism serves to move the body from a first position in juxtaposition to the bed of the truck and a second position above the side wall of the truck. The door is positioned above the side wall in the second position. The body has an indentation formed therein for extending over the wheel well of the truck. The body is positioned adjacent the side wall of the pickup truck such that the door is interposed between the body and the side wall in the first position. The lift mechanism includes a first hydraulic cylinder affixed to a first end of the body and a second hydraulic cylinder affixed to a second end of the body. A hydraulic actuator is connected to the first and second hydraulic cylinders so as to move the body between the first and second positions.

One of the problems associated with the actual development of the product associated with U.S. Pat. No. 5,303,969 was the difficulty associated with the use of hydraulics. In particular, hydraulics can be very messy if any leaks in the hydraulic connection should occur. Additionally, the mechanisms for driving the hydraulics associated with the system of this prior patent were relatively expensive. Maintenance proved to be a continual difficulty. Additionally, purchasers of such storage containers would find that despite proper sealing techniques, leaks in hoses, equipment, pumps and other components of the system would create an aesthetically unappealing product.

So as to overcome the problems associated with hydraulics, various mechanical mechanisms were investigated. With any mechanical mechanisms, it was important to provide a suitable motor drive and suitable mechanical linkages so that the tool box could be lifted from its stowed position to its elevated position. In any event, the lifting mechanism should have the capability of lifting in excess of 400 pounds.

Scissor lift mechanisms have been known in the past. The most common type of scissor lift mechanism is associated with the jack of a vehicle. A shaft extends between a pair of scissors and is mechanically rotated with a wrench or other device. The continual rotation of the shaft will draw one scissor toward the other scissor and, hence, lift a top plate relative to a bottom plate. Unfortunately, an excessive number of rotations of the shaft are required so as to provide the necessary lifting capability. Additionally, the force required to lift the scissor mechanism from its lowermost position would be exceedingly great when a load, such as the storage device, is placed thereon. As such, any scissor lift mechanism would have to accommodate the requirements for compact stowage, maximum lifting capability and relatively quick lifting capability. The size and expense of the lifting equipment would have to be minimized as much as possible.

In the past various U.S. patents have issued relative to scissor lift devices. For example U.S. Pat. No. 3,785,462, issued on Jan. 15, 1974 to Coad et al., describes a scissor lift having upper and lower platforms which is actuated by a cable reeved so as to pull the ends of the scissor together in its extended position and also reeved about a cam roller interposed between the arms and working toward the pivotal connection during the portion of the motion in which the lift begins to extend. U.S. Pat. No. 3,843,115, issued on Oct. 22, 1974 to Di Fulvio et al., describes an elevator apparatus for raising and lowering a platform. A lift mechanism, movable along a path parallel to the platform path, is coupled to the platform through an elongated member pivotally connected to the lift mechanism. The elongated member detachably engages the platform at two points, one on each side of the member, such that the pivoting movement of the member is restricted and that a lifting force can be transmitted therethrough from the lift mechanism to the platform.

U.S. Pat. No. 4,391,345, issued on Jul. 5, 1983 to J. N. Paul, describes an elevatable scaffold. The lift assembly includes a series of elongated structural assemblies each pivoted at one end and the middle thereof to some other structural assembly in the series. A cable passes substantially parallel with some of the structural assemblies and between the ends of mutually pivoted structural assemblies. A winch assembly is mounted on the base and receives the other end of the cable wound thereon so that the operation of the winch effects elevating of the platform by winding the cable.

U.S. Pat. No. 4,534,544, issued on Aug. 13, 1985 to C. Heide, describes a lift having a platform and a scissors jack that is attached to the bottom of the platform. One pair of the parallel scissoring legs of the jack is firmly articulated with the platform and the other pair of the scissoring legs is attached to a shaft that travels parallel to the bottom of the platform. Roller are mounted on a rigid axle and the axle is engaged by two chains that wrap around the chain wheels rigidly attached to the shaft and which are connected to a transverse beam.

U.S. Pat. No. 5,366,203, issued on Nov. 22, 1994 to C. E. Huffman, describes a lift mechanism with a scissor-like stabilizer mechanism.

U.S. Pat. No. 5,395,209, issued on Mar. 7, 1995 to Busse et al., describes palletizer having a scissor lift assembly for moving the supporting member relative to the base. A motor has an output shaft which is connected to the scissor structure such that the supporting member moves upwardly at a generally constant velocity in response to the rotation of the output shaft.

U.S. Pat. No. 6,364,060, issued on Apr. 2, 2002 to C. W. Cherry, describes another type of low profile lift assembly. This apparatus has lift platform which accommodates a manufactured product on a support surface and elevationally lifts the manufactured product to a vertical level or elevation. The apparatus also has a base adapted to rest on the floor with the lift platform interconnected to the base for movement between the raised and lowered positions.

U.S. Patent Application Publication No. US 2002/0139618, published on Oct. 3, 2002, describes a device for maintaining parallelism between a base structure and a movable structure. There is provided opposed pairs of pivoting arms which are synchronized by a timing device which links an arm with the arm opposite to it and ensures that these arms move the same distance but in opposite directions.

It is an object of the present invention to provide a toolbox that can move vertically in the bed of a pickup truck.

It is another object of the present invention to provide a toolbox that conveniently fits over the wheel well of the bed of the pickup truck.

It is another object of the present invention to provide a toolbox that is generally theft proof in its lowered position.

It is still another object of the present invention to provide a toolbox for pickup trucks that can be remotely operated from the interior of the pickup truck or at a location exterior of the pickup truck.

It is still a further object of the present invention to provide a toolbox that can be raised to an eye level position along the sidewall of a pickup truck.

It is still another object of the present invention to provide a toolbox assembly, which prevents rocks, and other items from the bed of the pickup truck, from residing beneath the toolbox.

It is still a further object of the present invention to provide a toolbox that is easy to manipulate, easy to use, convenient, and relatively inexpensive.

It is still a further object of the present invention to provide a lift mechanism which generates maximum lifting capacity in a very small and low profile device.

It is a further object of the present invention to provide a lift device for the tool box of a vehicle which avoids the use of hydraulic mechanisms.

These and other objects and advantages of the present invention will become apparent from a reading of the attached specification and appended claims.

BRIEF SUMMARY OF THE INVENTION

The present invention is a storage device for the bed of a pickup truck. The storage device has a body with a storage area therein and a scissor lifting means attached to the body for moving the body between a first position in juxtaposition to the bed of the truck and a second position above a side wall of the truck. The body includes a door that allows access to the storage area within. The door is positioned above the side wall when the scissor lifting means lifts the body to the second position.

In the present invention, the scissor lifting means includes a top plate affixed to a surface of the body, a bottom plate affixed to a surface of bed of the truck, a first scissors pivotally connected to the top plate and at an opposite end to the bottom plate, a second scissors pivotally connected to the top plate and at an opposite end to the bottom plate, and a motor cooperative with at least one of the scissors so as to move the top plate relative to the bottom plate.

The storage body has an indentation formed therein. This indentation has an area greater than the wheel well of the truck. The top plate is affixed to the body within this indentation. The bottom plate is attached to the top of the wheel well of the truck.

In the present invention, each of the first and second scissors includes a first beam having an end pivotally secured to the top plate and a second beam having an end pivotally secured to the bottom plate. The first beam has an opposite end pivotally connected to an opposite end of the second beam. An axle extends through the pivotal connection of the first beam with the second beam. The motor is cooperative with the axle for selectively rotating the axle. A linkage extends from the axle of the first scissors to the axle of the second scissors. A first wheel member is positioned on the axle of the first scissors and a second wheel member is positioned on the axle of the second scissors. The linkage is received by the first and second wheel members. A first gear arrangement is mounted on the axle of the first scissors. A first motor is drivingly connected to the first gear arrangement so as to rotate the axle and the first wheel member. A second gear arrangement is mounted on the axle of the second scissors. A second motor is drivingly connected to the second gear arrangement so as to rotate the axle and the second wheel member. In particular, the first gear arrangement is a worm gear affixed to the axle of the first scissors and worm meshed with the worm gear. The worm is affixed to a shaft of the first motor. The second gear arrangement includes a worm gear affixed to the axle of the second scissors and a worm meshed thereto. The worm is affixed to the shaft of the second motor. In the present invention, the linkage can be either a chain or a cable. If the linkage is a chain, then the first wheel member is in the form of a sprocket engaged with links at one location on the chain. The second wheel member is also a sprocket engaged with links at another location on the chain.

In the present invention, a spring has one affixed to the first scissors and an opposite end affixed to the second scissors. The spring urges the first scissors toward the second scissors so as to assist in the lifting motion associated therewith.

The present invention is also a lift device that could be operated independently of the lifting of a toolbox and can be used for other purposes, such as the lifting of a vehicle or other external apparatus.

BRIEF DESCRIPTION OF THE SEVERAL VIEWS OF THE DRAWINGS

FIG. 1 is a side elevational view of the storage device of the present invention as viewed from the bed of the pickup truck.

FIG. 2 is an end view of the storage device of the present invention.

FIG. 3 is a side elevational view of the storage device of the present invention viewed from the exterior of the pickup truck.

DETAILED DESCRIPTION OF THE INVENTION

Figure 4:
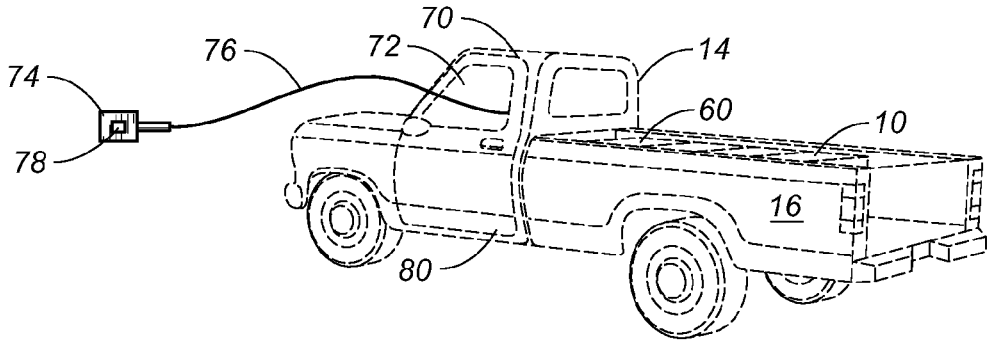
FIG. 4 is a perspective view of a pickup truck with the storage device in its lowered position having a remote controller extending outwardly of the cab of the pickup truck.

Referring to FIG. 1, there is shown the storage device 10 in accordance with the preferred embodiment of the present invention. The storage device 10, as illustrated in FIG. 1, is shown from a view on the interior of the bed 12 of pickup truck 14. The pickup truck 14 is of a type having a bed 12 located in the rear of the pickup truck 14. A side wall 16 extends upwardly from the bed 12. A wheel well 18 is formed in side wall 16. The wheel well 18 is configured so as to allow sufficient room for the rotation and movement of the wheel of the pickup truck. The bed 12 includes a tailgate 20 hingedly connected to the rear of the bed 12.

The storage device 10 includes a body 22 which has a storage area therein. A door 24 is connected by hinges 26 to the top surface of the body 22. The door 24 allows access to the interior of the storage area. The body 22 has an indentation 28 formed therein. As can be seen, the indentation 28 has a size greater than the size of the wheel well 18. Ideally, the indentation 28 will fit over the exterior of the wheel well 18 so as to maximize the storage area within the storage device 10. The body 22 includes a first flat bottom surface 30 and a second flat bottom surface 32 extending downwardly from the indentation 28. The flat surfaces 30 and 32 are suitable for surface-to-surface contact with the bed 12 of the pickup truck 14.

As can be seen, the storage device 10 has a length generally corresponding to the length of the bed 12 of the pickup truck 14. The top surface of the body 22 is planar and generally extends in parallel relation to the flat bottom surfaces 30 and 32. One end 34 is adjacent to the forward surface 35 of the bed 12 of pickup truck 14. The other end 36 is adjacent to the tailgate 20.

Importantly, the storage device 10 includes a scissor lift mechanism 38. The lift mechanism 38 is attached to the body 22. The lift mechanism 38 serves to move the body 22 from a first position in juxtaposition to the bed 12 of the pickup truck 14 and a second position, as illustrated in FIG. 1, above the side wall 16 of the pickup truck 14. The door 24 is positioned above the side wall 16 in its second position.

As can be seen, the scissor lift mechanism 38 includes a first scissor 40 and a second scissors 41. Each of the first scissors 40 and the second scissors 41 are pivotally attached at an upper end to a top plate 42. Top plate 42 is secured within the indentation 28 of the storage device 10. Similarly, the scissors 40 and 41 are connected at their bottom end to a bottom plate 43 affixed to the top of wheel well 18. A linkage 45 extends between the first scissors 40 and the second scissors 41. Similarly, a spring 47 is located below the linkage 45 and will extend between the scissors 40 and 41 so as to urge the scissors 40 and 41 toward their uppermost lifting position and toward each other. A more detailed description of the scissor lift mechanism 38 is described in association with FIGS. 5–7.

A channel member 44 is formed, or fastened, to the bed 12 adjacent to the side of the body 22 opposite the side wall 16. As can be seen, the channel member 44 extends upwardly from the bed 12 so as to form a receiving area for the body 22 in its first position. The channel member 44 extends longitudinally along the bed 12 from the surface 35 to the tailgate 20. The channel member 44 is configured so as to prevent rocks, bottles, debris, and other objects, from rolling underneath the surfaces 30 and 32 of the body 22. The presence of such objects under these surfaces 30 and 32 would tend to prevent the body 22 from properly being lowered into its first position.

FIG. 2 shows an end view of the storage device 10. The storage device 10 extends upwardly vertically from the bed 12 of the pickup truck 14. The body 22 has a side wall 46 extending upwardly vertically and in juxtaposition against a surface of the channel member 44. The side 46 serves as the back surface of the storage device 10. The side 46 also serves as an area for the retaining of objects on the bed 12 of the pickup truck 14. In essence, the side 46 serves the same function as the side wall 16 without the obstruction of the wheel well 18. Importantly, it can be seen that the door 24 is hingedly to the top surface of the body 22. Specifically, the hinges 26 are connected to the top of the side 46. The door 24 forms the top surface of the body 22 and extends downwardly therefrom. As can be seen, the bottom edge 50 of the door 24 is interposed between the side wall 16 and the body 22. This is an important aspect of the present invention. When the storage device 10 is in its lowered position against the bed 12 of the pickup truck 14, the bottom edge 50 of the door 24 is interposed against the side wall 16 and the body 22. In the lowered position, it is impossible to open the door 24. As a result, it is not necessary to use locking devices for the purpose of securing the storage device 10. It is only necessary that the body 22 be lowered so that the bottom 30 is in juxtaposition to the bed 12. Since the door 24 is received in this manner, it is impossible to grip the bottom edge 50 for the purpose of rotating the door 24 about its hinges 26.

The body 22 includes rollers 52 that are interposed between the side wall 16 and the door 24. The rollers 52 can be rotatably mounted to the side wall 16 of the pickup truck 14 or they can be mounted to the exterior surface of the door 24. The rollers 52 serve to facilitate the ability to move the body 22 from its lowermost position to its uppermost position. The rollers 52 further serve to prevent abrasive contact between the body 22 and the interior surfaces of the side wall 16.

In the lowered position, as illustrated in FIG. 2, the indentation 28 is fitted over the exterior surface of the wheel well 18. The storage device 10 maximizes the available area for the storage of tools by fitting over the wheel well 18. FIG. 3 illustrates the body 22 in its second, or uppermost, position. As can be seen, the body 22 is raised above the top 60 of the side wall 16 of the pickup truck 14. In the position illustrated in FIG. 3, the storage device 10 is in a suitable position for access to tools, and other items, contained therein. As can be seen, the storage device 10 has a body 22 with a storage area 62 contained therein. Door 24 is hingedly connected at 26 to the body 22. The door 24 is illustrated as opened for the purpose of allowing access to tools therein. The door 24 will rotate about its hinges 26 so as to allow the user to properly gain access to the storage area 62.

In FIG. 3, the storage device 10 is illustrated as having a first door 64, a second door 66, and a third door 68. The first door 64 is illustrated in its open position, as described herein previously. The second door 66 is positioned over the indentation 28 and will be positioned above the wheel well 18 of the pickup truck 14. The third door 68 is positioned adjacent to the end 34 adjacent to the back 36 of the pickup truck 14. The storage device 10 of the present invention thereby provides three compartments for the storage of tools. Since the bottom edges of each of the doors 64, 66, and 68 will reside below the top 60 of side wall 16 in the first, or lowered position, the storage device 10 will be properly secured without the need for locks.

FIG. 4 is a perspective view of pickup truck 14 with the storage device 10 in its lowered position. As can be seen, the top of the storage device 10 resides generally flush with the top 60 of the side wall 16. As such, the storage device 10 will present little or no wind resistance during normal travel in the pickup truck 14. The lowered position of the storage device 10 will not be obvious to passersby. Since the storage device 10 resides generally flush with the top 60, the storage device 10 will be very inconspicuous. The inconspicuous nature of the storage device 10 will further deter theft.

In FIG. 4, it can be seen that the pickup truck 14 includes a cab 70 placed forward of the storage device 10. The cab 70 has a window 72 as shown in a partially opened position. Importantly, the storage device 10, includes a remote controller 74 having an electrical line 76 extending into the cab 70. The remote controller 74 has an appropriate configuration so as to allow the remote manipulation of the storage device 10 between its first and second positions. The remote controller 74 has a button 78 thereon. The button 78 can be pressed so as to properly actuate the scissor lift mechanism for the raising and lowering of the storage device 10. The electrical line 76 has a length of at least six feet so as to allow the remote controller 74 to be properly positioned on the interior of the cab 70 or to be extended outwardly from the cab 70. Often, the user will find it convenient to use the remote controller 74 on the exterior of the pickup truck 14. Alternatively, the user may desire to utilize the remote controller 74 on the interior of cab 70. As such, the availability of the remote controller 74, and its extended electrical line 76, adds a great deal of flexibility to the use of the present invention. The line 76 can be extended outwardly of window 72 or can be extended through the opened door 80.

Figure 5:
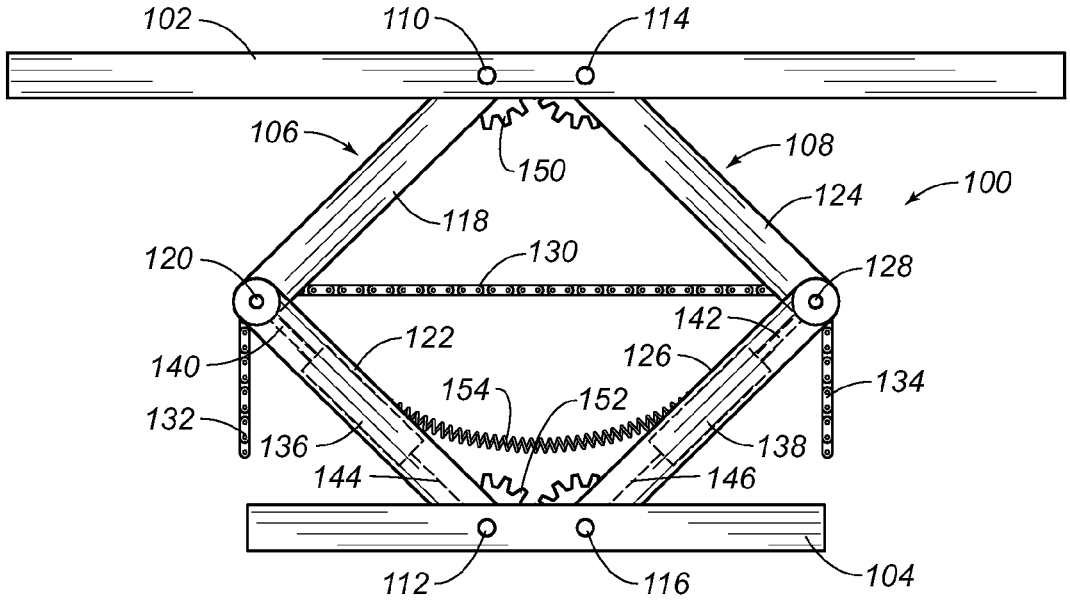
FIG. 5 is an isolated elevation view of the scissor lift mechanism in the raised condition.

Referring to FIG. 5, there is shown the scissor lift mechanism 100 as isolated from the storage device 10. The lift mechanism 100 includes a top plate 102, a bottom plate 104, a first scissors 106, and a second scissors 108. The first scissors 106 is pivotally connected at 110 to the top plate 102 and pivotally connected at 112 to the bottom plate 104. The second scissors 108 is pivotally connected at 114 to the top plate 102 and is pivotally connected to the bottom plate 104 at pivot point 116. The first scissors 106 includes a first beam 118 that extends from pivot point 110 at one end to a pivot point 120. A second beam 122 is pivotally connected at 120 to the first beam 118 and is pivotally connected at its opposite end to the pivot point 112 associated with bottom plate 104. The second scissors 108 includes a first beam 124 which is pivotally connected to the top plate 102 at pivot point 114 and is pivotally connected to a second beam 126 at pivot point 128. Second beam 126 is pivotally connected to the bottom plate 104 at pivot point 116. A linkage 130 is illustrated as extending between the pivot points 120 and 128. Linkage 130 includes outwardly extending portions 132 and 134 extending over the respective pivot points 120 and 128. The linkage 130 can be in the nature of either a cable or a chain.

Each of the beams 118, 122, 124 and 126 are in the form of channel members. In the interior channels of each of the beams 122 and 126 are respective motors 136 and 138 (illustrated in broken line fashion). A shaft 140 extends toward the pivot point 120 from the motor 136. Similarly, a shaft 142 extends from the motor 138 toward the pivot point 128. Each of the motors 136 and 138 is of an identical size and serves to act on each of the pivot points 120 and 128 in an equal manner. A power line 144 extends from motor 122 so as to be powered by the vehicle's electrical system. Similarly, a line 146 extends from motor 138 so as to be powered by the vehicle's electrical system. Suitable gearing elements 150 serve to cause the beams 118 and 124 to cooperate together while pivoting about pivot points 110 and 114. Similarly, gearing elements 152 are formed on beams 122 and 126 so as to allow the beams to cooperate while rotating about pivot points 112 and 116. A spring 154 is illustrated in a slack condition extending between the beams 122 and 126. The spring 154 will be expanded when the scissor lift mechanism 100 is in its lowered position. This expansion serves to urge the scissors 106 and 108 toward each other and assist in the lifting action caused by the scissor lift mechanism 100.

Figure 6:
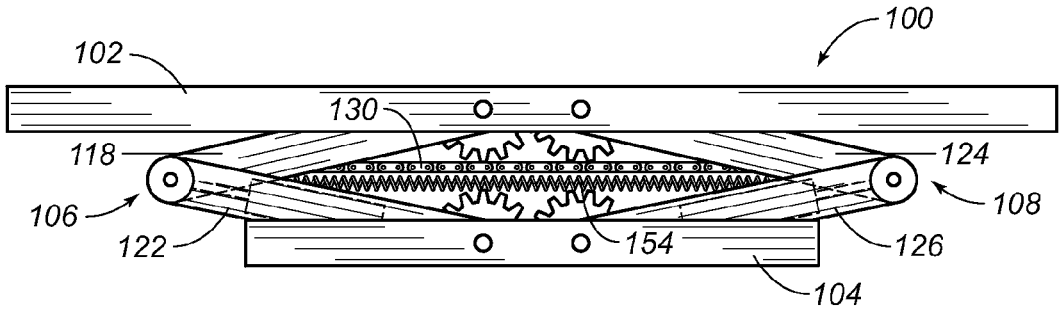
FIG. 6 is another isolated elevation view of the scissor lift mechanism in the lowered condition

FIG. 6 illustrates the scissor lift mechanism 100 in its lowered condition. As can be seen, the first scissors 106 is lowered so as to have a sharper angle between the beams 118 and 122. The second scissors 108 is also lowered so that there is narrow angle between the beams 124 and 126. As a result, the top plate 102 will be very close to the bottom plate 104. The linkage 130 is extended so that the very ends of the outwardly extending portions 132 and 134 are adjacent to the pivot points 120 and 128. Similarly, the spring 154 is greatly expanded so as to be in tension so as to urge the scissors 106 and 108 toward each other. When the respective motors 136 and 138 are activated, the spring 154 will compensate for the initial high torque condition required to move the plates 102 and 104 outwardly from each other.

Figure 7:
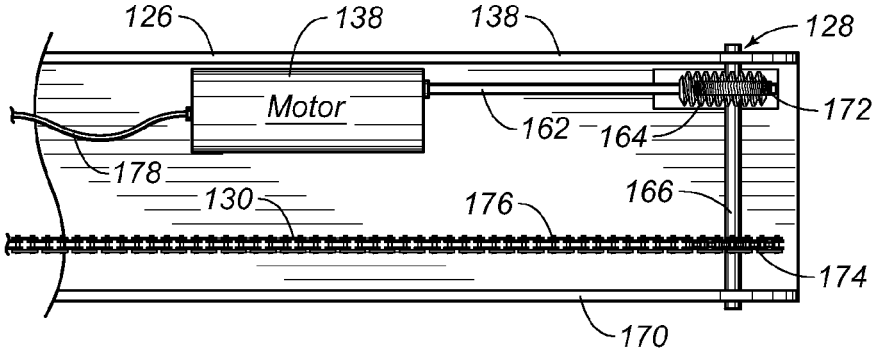
FIG. 7 is an internal side elevation view of the invention, showing the configuration of the motor within the channel defined by the interior of the beam.

FIG. 7 illustrates the configuration of the motor 138 within the channel 160 defined by the interior of beam 126. It is important to note that the interior of beam 122 will have an identical configuration. It can be seen that the motor 138 has a shaft 162 extending outwardly therefrom. A worm 164 is secured to the end of shaft 162 opposite the motor 138.

Importantly, it can be seen that the pivot point 128 is actually an axle 166 which extends between the flanges 168 and 170 that define the channel 160. A worm gear 172 is mounted on the axle 166 and is meshed with worm 164. Similarly, a wheel member 174 is mounted in spaced relationship on axle 166. Wheel member 174 is a sprocket which engages lengths of the chain 176 which forms the linkage 130. A similar arrangement associated with the pivot point 120 will engage a different location along the length of the chain 176. As a result of this configuration, as the motor 138 is activated so as to rotate the shaft 162, the worm 164 will rotate so as to cause the corresponding rotation of the worm gear 172 and the axle 166. The rotation of the axle 166 will cause a rotation of the sprocket 174 so as to move along the length of the chain 176 and draw the axle 166 toward the axle associated with the pivot point 120. An electrical or control line 178 is connected to the motor 134 so as to control the relative lifting motion on the scissor lift mechanism 100. It is to be noted that the chain 176 can be replaced by a suitable cable which is reeved onto the wheel member 174 on axle 166.

It is important to note that the use of the worm 164 and the worm gear 172 prevents the downward movement of the scissor lift mechanism 100. It is fundamental that a worm gear cannot drive a worm. As such, involuntary reverse action will not occur when the motor 138 is deactivated. It is only the reverse driving of the motor 138 which will cause the scissor lift mechanism 100 to lower.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A storage device for a bed of a pickup truck, the bed having a side wall with a wheel well formed therein, the storage device comprising:

a body having a storage area therein, said body having a door affixed thereto, said door for allowing access to said storage area;

a scissor lifting means attached to said body, said scissor lifting means for moving said body between a first position in juxtaposition to the bed of the truck and a second position above the side wall of the truck, said door positioned above the side wall in the second position, said scissor lifting means comprising:

a top plate affixed to a surface of said body;

a bottom plate affixed to a surface on the bed of the truck;

a first scissors pivotally connected at one end to said top plate at an opposite end to said bottom plate, said first scissors having an axle;

a second scissors pivotally connected at one end to said top plate at an opposite end to said bottom plate, said second scissors having an axle; and a motor cooperative with at least one of said first and second scissors so as to move the top plate relative to the bottom plate;

a linkage extending from the axle of said first scissors to the axle of said second scissors;

a first wheel member positioned on the axle of said first scissors;

a second wheel member positioned on the axle of said second scissors, said linkage being received by said first and second wheel members;

a first gear arrangement mounted on the axle of said first scissors, said motor drivingly connected to said first gear arrangement so as to rotate the axle and said first scissors and said first wheel member; and a second gear arrangement mounted on the axle of said second scissors, the second motor drivingly connected to said second gear arrangement so as to rotate the axle said second scissors and said second wheel member.

2. The storage device of claim 1, said body having an indentation formed therein, said indentation having an area greater than the wheel well of the truck, said top plate affixed to said body within said indentation.

3. The storage device of claim 1, said surface on the bed of the truck being a wheel well of the truck.

4. The storage device of claim 1, each of said first and second scissors comprising:

a first beam having one end pivotally secured to said top plate; and a second beam having an end pivotally secured to said bottom plate, said first beam having an opposite end pivotally connected to an opposite end of said second beam.

5. The storage device of claim 4, further comprising:

an axle extending through the pivotal connection of said first beam with said second beam, said motor being cooperative with said axle for selectively rotating said axle.

6. The storage device of claim 1, said first gear arrangement comprising a worm gear affixed to the axle of said first scissors and a worm meshed with said worm gear, said worm affixed to a shaft of said first motor.

7. The storage device of claim 6, said second gear arrangement comprising a worm gear affixed to the axle of said second scissors and a worm meshed with said worm gear of said second gear arrangement, said worm of said second gear arrangement affixed to a shaft of said second motor.

* * * * *